US006702198B2

(12) United States Patent
Tam et al.

(10) Patent No.: US 6,702,198 B2
(45) Date of Patent: Mar. 9, 2004

(54) REVERSIBLE AIRLESS SPRAY TIP ASSEMBLY

(75) Inventors: Jimmy W. Tam, Plymouth, MN (US); Dale C. Pemberton, Rockford, MN (US); Steven P. Plager, Eden Prairie, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

(21) Appl. No.: 09/795,995

(22) Filed: Feb. 28, 2001

(65) Prior Publication Data

US 2001/0032889 A1 Oct. 25, 2001

Related U.S. Application Data

(60) Provisional application No. 60/185,647, filed on Feb. 29, 2000.

(51) Int. Cl.[7] ..... B05B 1/28; B05B 15/04

(52) U.S. Cl. ..... 239/119; 239/106; 239/288.5; 239/104

(58) Field of Search ..... 239/119, 106, 239/104, 288, 288.3, 600, 288.5; 251/172, 174, 312, 368

(56) References Cited

U.S. PATENT DOCUMENTS

| | | | | | |
|---|---|---|---|---|---|
| 4,165,836 | A | | 8/1979 | Eull | 239/119 |
| 4,483,481 | A | | 11/1984 | Calder | 239/119 |
| 4,484,707 | A | | 11/1984 | Calder | 239/119 |
| 4,513,913 | A | * | 4/1985 | Smith | 239/119 |
| 4,537,355 | A | | 8/1985 | Calder | 239/119 |
| 4,635,850 | A | | 1/1987 | Leisi | 239/119 |
| 4,715,537 | A | | 12/1987 | Calder | 239/119 |
| 4,757,947 | A | | 7/1988 | Calder | 239/119 |
| 4,830,281 | A | * | 5/1989 | Calder | 239/119 |
| 4,971,249 | A | | 11/1990 | Tam et al. | 239/119 |
| 5,340,029 | A | | 8/1994 | Adams | 239/119 |
| 5,379,939 | A | | 1/1995 | Perret, Jr. | 239/119 |
| 5,524,935 | A | * | 6/1996 | Everts | 285/23 |
| 5,746,416 | A | | 5/1998 | Paylor | 251/291 |
| 6,059,202 | A | * | 5/2000 | Zink et al. | 239/259 |
| 6,390,386 | B2 | * | 5/2002 | Krohn et al. | 239/119 |

* cited by examiner

*Primary Examiner*—Davis Hwu
(74) *Attorney, Agent, or Firm*—Douglas B. Farrow

(57) ABSTRACT

A reversible airless spray tip is provided with a housing for mounting to the front of a spray gun, a sealing saddle insertable into the housing, a seal associated with the saddle and a rotatable cylinder having a handle and containing an airless tip. The cylinder is insertable in the housing and has a protrusion on said cylinder for engaging and releasably retaining said seal for insertion into said housing.

1 Claim, 3 Drawing Sheets

REVERSIBLE AIRLESS SPRAY TIP ASSEMBLY

RELATED APPLICATIONS

This application claims the benefit of Provisional No. 60/185,647 filed on Feb. 29, 2000.

BACKGROUND OF THE INVENTION

Reversible airless spray tips are well known as shown by U.S. Pat. No. 4,165,836 as well as U.S. Pat. No. 4,484,707, and its progeny.

SUMMARY OF THE INVENTION

It is always an object of an invention in this area to improve on the performance of such tips, particularly in the areas of sealing and adhesive use. Towards that end, a one-piece solvent resistant rubber step seal is provided with a 316 stainless steel powder metal saddle which provides an interference fit between the step of the seal of approximately 0.006 inches. This holds both parts together and forms effectively a one-piece design.

The solvent resistant rubber step seal works like a face seal under fluid pressure and the spring to hold the tip in place and the guard when no fluid pressure is present. As the result the tip can be installed or removed from the guard without using any tool to loosen the nut and independent from how tight the nut is tightened as long as the guard is tightened metal-to-metal with the gun. A 0.16 inch OD with a 0.096 inch protrusion is machined on the tip cylinder whereby the tip cylinder may be used to insert the one piece seal by placing it on the protrusion and inserting it into the housing. The arrow point on the handle may be used to push the one-piece seal from the front of the guard for removal.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
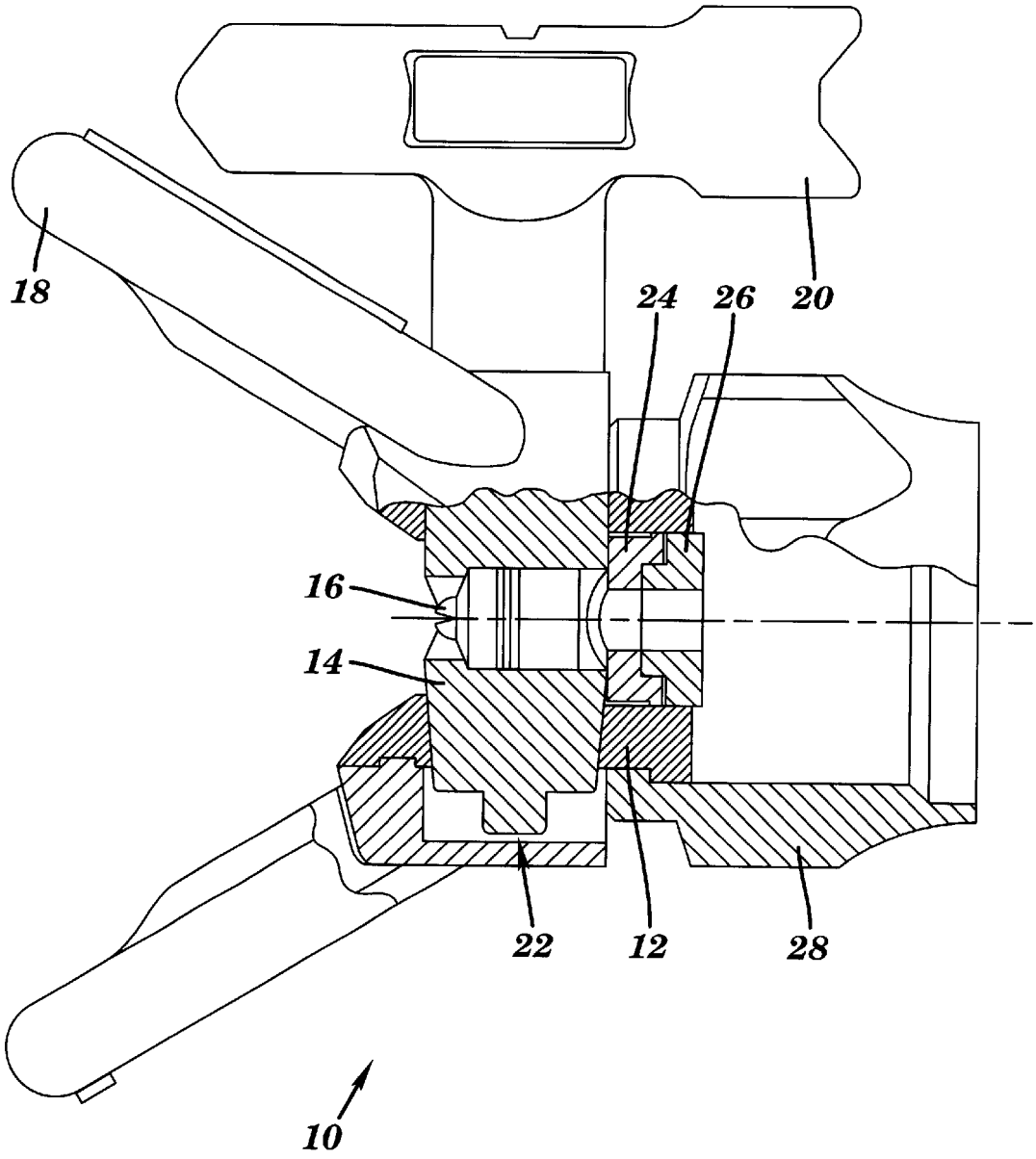
FIG. 1 shows a partially cutaway view of the tip assembly of the instant invention.

FIG. 1 shows a partially cutaway view of the tip assembly 10 which is comprised generally of a housing 12 having a tip cylinder 14 inserted therein with an airless tip 16 located inside cylinder 14. A tip guard 18 extends divergently from the front thereof and tip cylinder 14 is provided with a handle 20. Cylinder 14 has at the other end thereof a protrusion 22, the purpose of which will be discussed more fully hereinafter. A saddle member 24 is ideally formed of 316 stainless steel powdered metal and provides a slight interference fit (0.006 inch) in the rear thereof for a seal 26.

Figure 3:
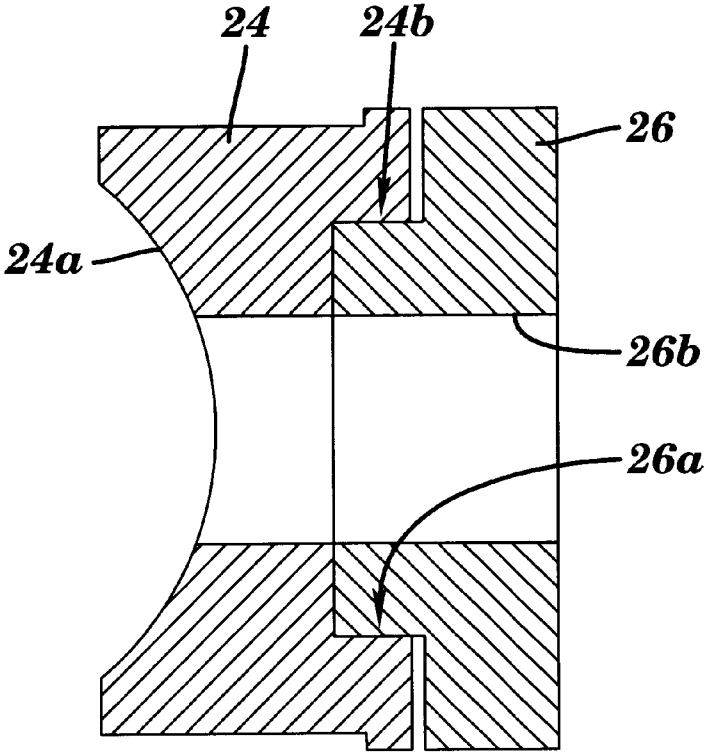
FIG. 3 is a sectional view of FIG. 2 taken along line 3—3.
Figure 2:
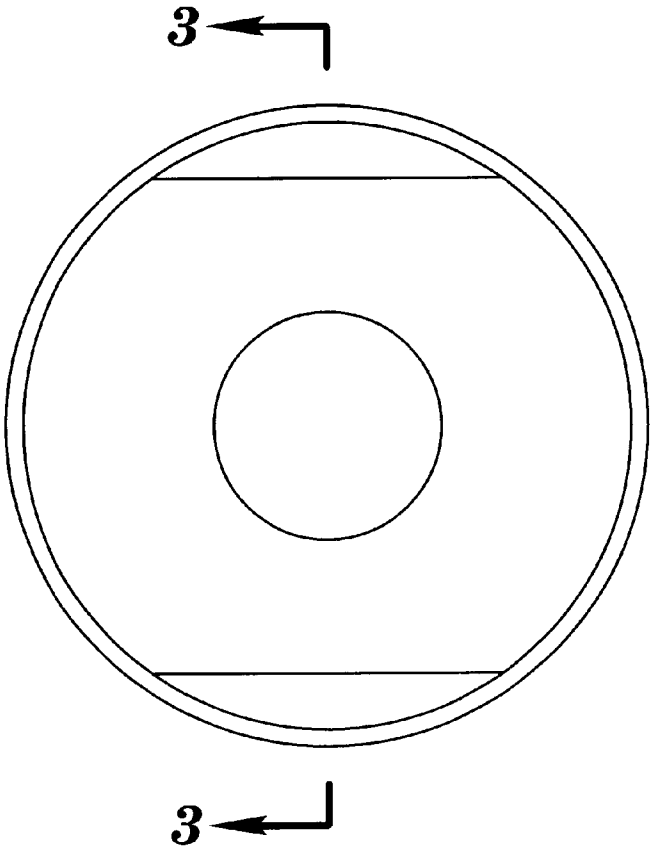
FIG. 2 shows a front view of the seal/saddle assembly.

As can be seen more fully in FIG. 3, saddle member 24 is provided with a cylinder sealing surface 24*a* and a rear cavity 24*b* into which step 26*a* of seal 26 may be inserted. Seal 26 has a through passage 26*b* therein.

Figure 4:
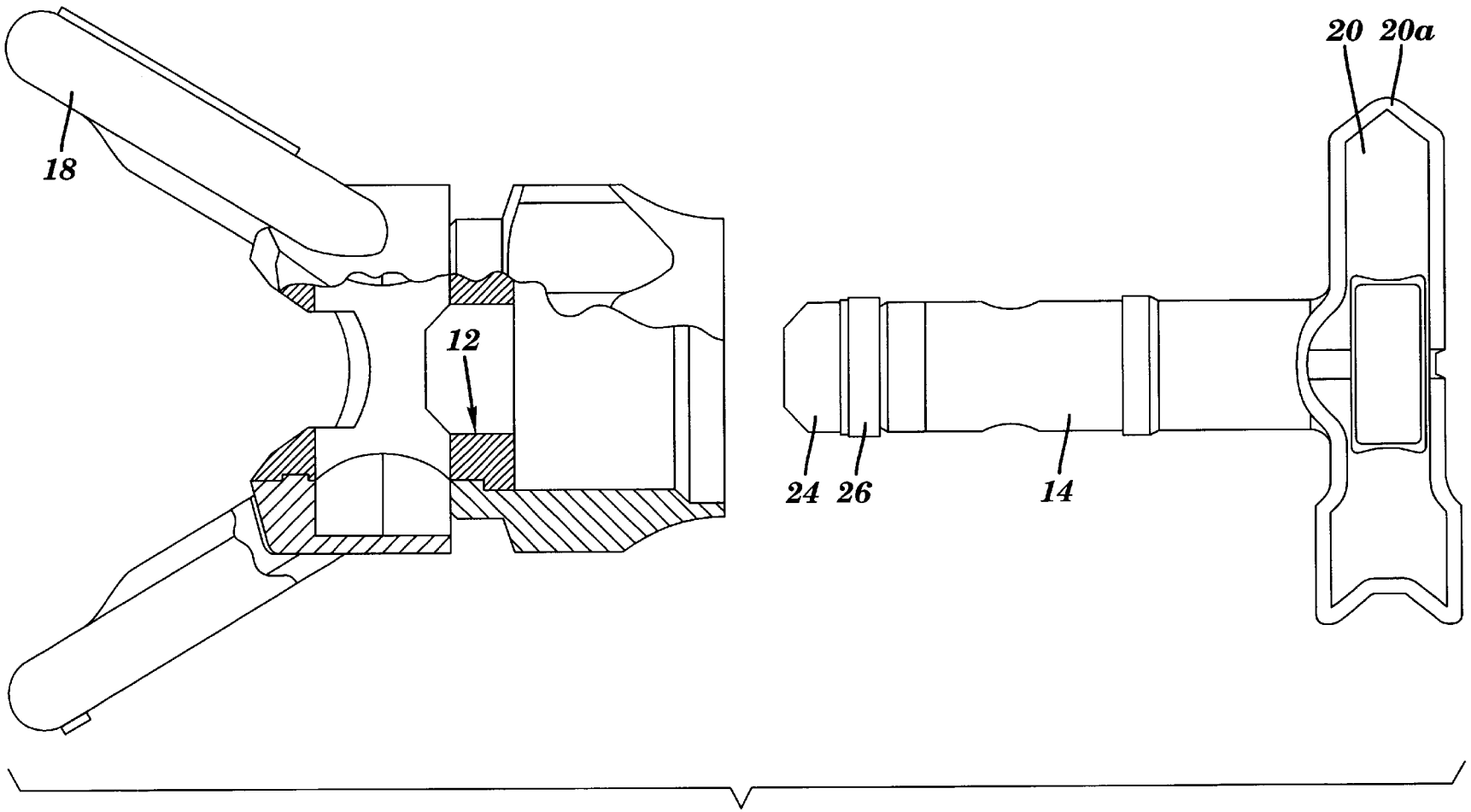
FIG. 4 is a partially cutaway exploded view showing the tip assembly being assembled.

As can be seen in FIG. 4, the protrusion 22 on the end of cylinder 14 is inserted into passage 26*b* of seal saddle assembly 24/26 and is then inserted into housing 12. Removal may be accomplished by pressing rearwardly using the tip 20*a* of arrow 20 to do so.

It is contemplated that various changes and modifications may be made to the tip assembly without departing from the spirit and scope of the invention as defined by the following claims.

What is claimed is:

1. In a reversible airless spray tip assembly comprising a housing for mounting to the front of a spray gun, a sealing saddle insertable into said housing, a seal associated with said saddle, said seal having a rear end with a recess therein and a rotatable cylinder having a handle and containing an airless tip, said cylinder being insertable in said housing, the improvement comprising a protrusion on the exterior of said cylinder for engaging into and releasably retaining said recess of said seal for insertion of said seal into said housing, the portion of said cylinder which engages said seal being remote from said seal during normal operation of said reversible airless spray tip assembly.

* * * * *